US006129226A

United States Patent [19]

Donovan

[11] Patent Number: 6,129,226

[45] Date of Patent: Oct. 10, 2000

[54] VEHICLE MOUNTED MINI HOIST

[76] Inventor: Timothy J. Donovan, 68 Lafayette Rd., Plymouth, Mass. 02360

[21] Appl. No.: 09/246,223

[22] Filed: Feb. 8, 1999

[51] Int. Cl.[7] ..... B66C 23/42

[52] U.S. Cl. ..... 212/300; 212/238; 212/261; 212/304

[58] Field of Search ..... 212/180, 305, 212/230, 300, 238, 261, 304

[56] References Cited

U.S. PATENT DOCUMENTS

| | | | |
|---|---|---|---|
| 3,815,689 | 6/1974 | Kuhl | 173/46 |
| 3,861,535 | 1/1975 | Huxley et al. . | |
| 3,871,618 | 3/1975 | Funk . | |
| 3,917,005 | 11/1975 | Cannon et al. | 173/147 |
| 3,978,937 | 9/1976 | Chichester et al. . | |
| 3,987,563 | 10/1976 | Baur | 37/73 |
| 4,081,055 | 3/1978 | Johnson . | |
| 4,085,853 | 4/1978 | Van Der Lely | 212/305 |
| 4,135,592 | 1/1979 | Wincent | 180/51 |
| 4,222,186 | 9/1980 | Molby | 37/81 |
| 4,605,132 | 8/1986 | Van Seumeren | 212/230 |
| 4,700,851 | 10/1987 | Reeve et al. | 212/180 |
| 4,925,159 | 5/1990 | Younes . | |
| 5,253,845 | 10/1993 | Wilbert . | |
| 5,554,646 | 9/1996 | Lewis et al. . | |
| 5,622,235 | 4/1997 | Merritt . | |
| 5,954,143 | 9/1999 | McCabe et al. | 173/184 |

*Primary Examiner*—Thomas J. Brahan
*Attorney, Agent, or Firm*—D. Michael Burns

[57] ABSTRACT

In connection with a pair of pivotally connected articulating booms there is a pair of double-acting hydraulic cylinders which control the vertical pulling of well pipe, such that a boom assembly in conjuction with an improved winch assembly willgenerate at least a 1500 pound perpendicular pulling force to a vertical height of at least 23.5 feet. This is done with a mini hoist, releasably mounted upon a hydraulically self-propelled 4×4 vehicle. The entire weight of the mini hoist is less than 1500 pounds and in the collapsed stage can fit within a box truck or on a pickup truck.

4 Claims, 5 Drawing Sheets

VEHICLE MOUNTED MINI HOIST

BACKGROUND OF THE INVENTION

1. Field of the Invention

The present invention relates generally to a vehicle mounted articlated boom apparatus and more particularly to an apparatus for vertical withdrawal of well pipe and other like objects. The vehicle being a mini truck which can also be used as a utility vehicle.

2. Description of the Prior Art

The present invention fills a long felt need for a compact, four wheel drive, self propelled vehicle having the capability to vertically withdraw well pipe and the like. Large rigs, which are currently used by the well and pump contractor, are often limited as to their accessibility to the work site. Structural obstacles such as trees, power lines, fences, swimming pools, valuable landscaping and other impediments, which in many cases did not even exist when the well was originally installed make the use of the large rig either very difficult or even impossible in many instances. Also quite often the terrain has changed due to erosion or other developments that make the large rig a potential hazzard. The combination of the heavy weight of the rig coupled with delicate soil conditions are other problems the contractor faces.

An unnecessary expense the well contractor has to absorb, is when two people have to be sent out on a job that requires only a single worker. This added cost must generally be passed on to the the consumer. The reason for this inefficiency is that on most jobs, the contractor needs to have a hoist truck for pulling the well pipe, and also a box or pick-up truck for carrying all the tools and parts to the job site. This requires two drivers, although only one is needed to perform the work. Thus, there is a need for a vehicle that will combine both the hoist and the extra truck, thereby eliminating one of the workers.

Some conventional solutions, which are available for pipe removal, often do not support the pipe for the full vertical extension from the ground. This can cause the pipe to bend or buckle under its own weight. A boom attachment is normally the best means to raise the pipe in a vertical and completely supported manner. One difficulty of the prior art apparatus, wherein booms are used, is that only the extremely heavy rigs will supportively lift the heaviest pipes up to at least 20 vertical feet. The booms must be articulated to each other and the requirement of outriggers is necessary to stabilize the vehicle. Overcoming this counterweight need has created numerous patents in the prior art. None of the prior art discloses a mini hoist, having the small structure of the present invention, yet still being able to support a vertical lift of more than 20 feet.

The prior art also presents many well known means for providing a high pressure, large hydraulic cylinder for raising and lowering boom members. The large cylinder has inherent disadvantages in that it must accommodate the lower boom when it is in the collapsed stage. Typically, the lower boom will have a U-shaped chassis, which allows the cylinder to be depose within the chassis of the boom when the hoist assembly is lowered. The disadvantage of the U-shaped chassis is that it must be larger, and therefore heavier, for any given load-bearing capacity. This is a very important consideration in striving for a small, light-weight apparatus.

U.S. Pat. No. 5,622,235 issued to Merritt on Apr. 22, 1997, shows a vehicle on tracks with hydraulically activated outriggers for support. Merritt has designed his vehicle to be accessible in such areas as residential back yards. The vehicle is small, maneuverable and self-propelled, however the boom arrangement is of a single boom with two distinct sections. This apparatus would not have the ability to supportively raise well pipe in a perpendicular direction U.S. Pat. No. 4,925,159 issued to Younes on May 15, 1990, discloses a vehicle for pulling well points and the like utilizing a boom and outriggers. The size of his vehicle is about 6 feet by 11.5 feet. This is an improvement over the prior art but is still remains relatively heavy and could not be fit within a box truck. Younes' vehicle would also not supportively raise the pipe to any where near the minimum requirement of 20 feet.

U.S. Pat. No. 5,554,646 issued to Lewis et al. on Dec. 17, 1996, teaches the use of a mobile, self-propelled apparatus utilizing two boom sections actuated by hydraulic cylinder. As in most of the prior art, Lewis et al. does not show any means for pivoting the booms 180 degrees relative to each other.

U.S. Pat. No. 4,081,055 issued to Johnson on Mar. 28, 1978, illustrates a vehicle mounted actuated boom apparatus. Johnson teaches the coordination of actuated power cylinders, to allow perpendicularity while avoiding the inherent danger of instability caused by raising the boom too high.

U.S. Pat. Nos. 5,253,845 and 3,871,618 issued to Wilbert and Funk respectively, disclose devices that are small, very portable and teach the lifting of well pipe and pumps. These devices are quite commonly used in the water well industry, however they cannot support the pipe in the raised position, and therefore the pipe is often susceptible to bending or buckling.

None of the above noted patents, taken either singly or in combination, are seen to disclose the specific arrangement or concepts disclosed by the present invention.

SUMMARY OF THE INVENTION

The present invention is a mini hoist assembly having improved articulated booms. The assembly is releasably mounted to a relatively small, hydraulically maneuverable, self-propelled vehicle.

The vehicle is formed of high strength, lightweight material such as steel. It has a support platform for mounting the hoist, which can be easily dismounted by the removal of a couple of quick disconnect pins.

The primary function of the vehicle is in transporting the the mini hoist to work sites, especially those having difficult accessibility due to obstructions, irregular terrain or close confinement situations that can be encountered in a residential backyard. The vehicle has 4×4 hydraulic drive and is manually manueverable by the operator walking along with it. The vehicle itself is only 38 inches wide, and when not supporting the hoist, it can be used as a utility truck. The vehicle and mini hoist are powered completely by gasoline engines and the combined weight of the hoist and vehicle is less than 1500 pounds. Because of the size and weight of the present invention, it is possible to transport it within a box or pick-up truck. A box truck is a truck used by well contractors to carry their parts and tools. Usually two men are required for most jobs; one to drive the large rig containing the hoist and another one to drive the box truck. The present invention provides for the necessity of only the box truck therefore eliminating one person from the job.

The mini hoist has four stabilizing, hydraulically operated outrigger assemblies, each outrigger being mounted at a corner of the hoist assembly. The outriggers each having a double-acting hydraulic cylinder, jack, and a foot pad, whereby the hoist is placed into ground engaging contact and the weight is spread over a larger area. The jacks can be raised and lowered through a 24 inch vertical stroke.

The hoist is comprised of upper and lower boom members with an improved articulation configuration that enables the booms to completely collapse or be elevated such that they can put into a 180 degree relationship to each other. The top of the upper boom will reach a minimum height of 23.5 feet when the assembly is completely extended.

The improved articulation assembly utilizes two substantially parallel plates to form a bracket housing. Within the bracket are means to pivotally connect the booms to each other. The same bracket pivotally connects two small double acting hydraulic cylinders. These cylinders maintain the booms in the correct orientation relative to one another.

Both of the booms have a box like chassis for maximum strength and minimum weight. An improved winch assembly mounted to the upper boom, using a 20 cubic inch hydraulic motor, willgenerate at least a 1500 lb pull at the load engaging point. To achieve the lifting capacity of the assembly, the lifting is confined to an area within the front hydraulic jacks.

The mini hoist in the collapsed state can be moved from site to site within the box truck. The preferred use of the hoist is to pull rigid steel and rigid PVC piping from potable water well systems. It can also pull 2 and 3 inch jet packers from a well. A secondary use for the unit would be pulling fence posts and poles, especially where a vertical pull is essential. The mini hoist often is not merely an alternative means to pulling these objects, but is the only practical means for certain work sites.

An object of the present invention is to have a pipe pulling device that can be mounted on a 4×4 vehicle that will allow accessibility to the most confined work sites.

Another object of the present invention is to have a device that can be transported within a box truck along with the standard tools and parts, so that only a single person will be required to perform the job.

Therefore, an object of the present invention is to have a working device that will not require removal of fences for access, nor will damage the landscape, nor will be impeded by utility lines, trees or poor terrain and soil conditions.

Another object of the present invention is to have an improved articulation boom system. One that allows for a completely perpendicular lift, wherein the booms, at their full extension, will be at a 180 degree relationship to each other. The top of the upper boom being at least 23.5 feet from the ground.

Still another object of the present invention is to have double-acting hydraulically activated outrigger jacks to stabilize the hoist.

Yet another object of the present invention is to have the upper boom completely collapsible upon the lower boom, for a very low overall height which will allow for the unit to fit within the box truck.

Another object of the invention is to avoid having the main double acting hydraulic lifting cylinder deposed within the lower boom, when the lower boom is in the collapsed state, thereby eliminating the necessity for booms to have a U-shape chassis; thus allowing for a boxed shaped chassis which will yield maximum strength and endurance for a given capacity.

An object of the invention is to have a winch system capable of generating a minimum of 1500 pounds of pull while utilizing a 20 cubic inch hydraulic motor.

Another object of the invention is to have a hoist apparatus which can be quickly disconnected from the vehicle by removing only two pins, thereby allowing the vehicle to be used as a utility truck.

Still a further object of the invention is to be able to power the entire assembly with only a 5 horse power gasoline engine.

These and other objects of the present invention will become readily apparent upon further review of the following specification and drawings.

DETAILED DESCRIPTION OF THE PREFERRED EMBODIMENT

Figure 1:
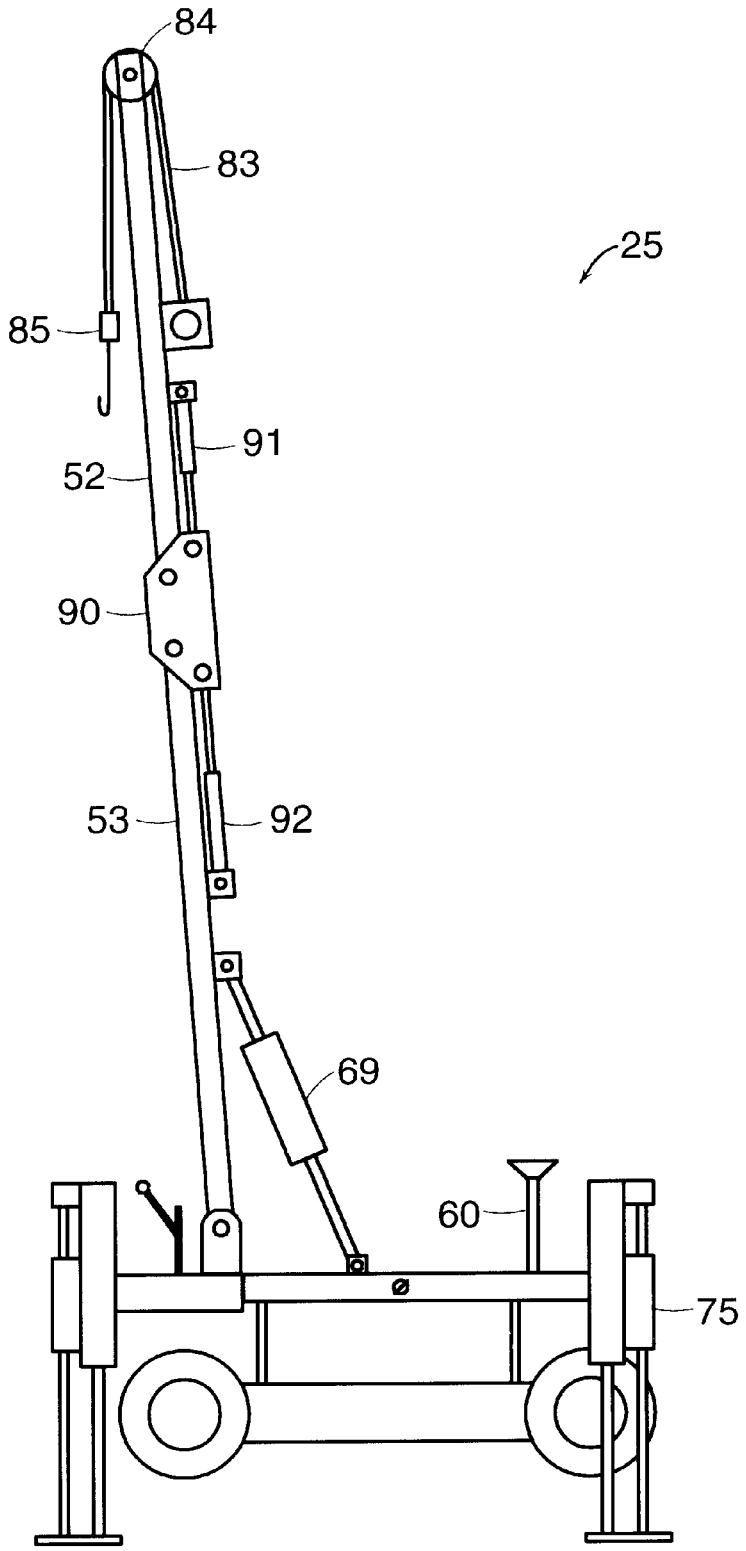
FIG. 1 is a frontal elevational view of the mini hoist with the booms extended to the maximum height.
Figure 2:
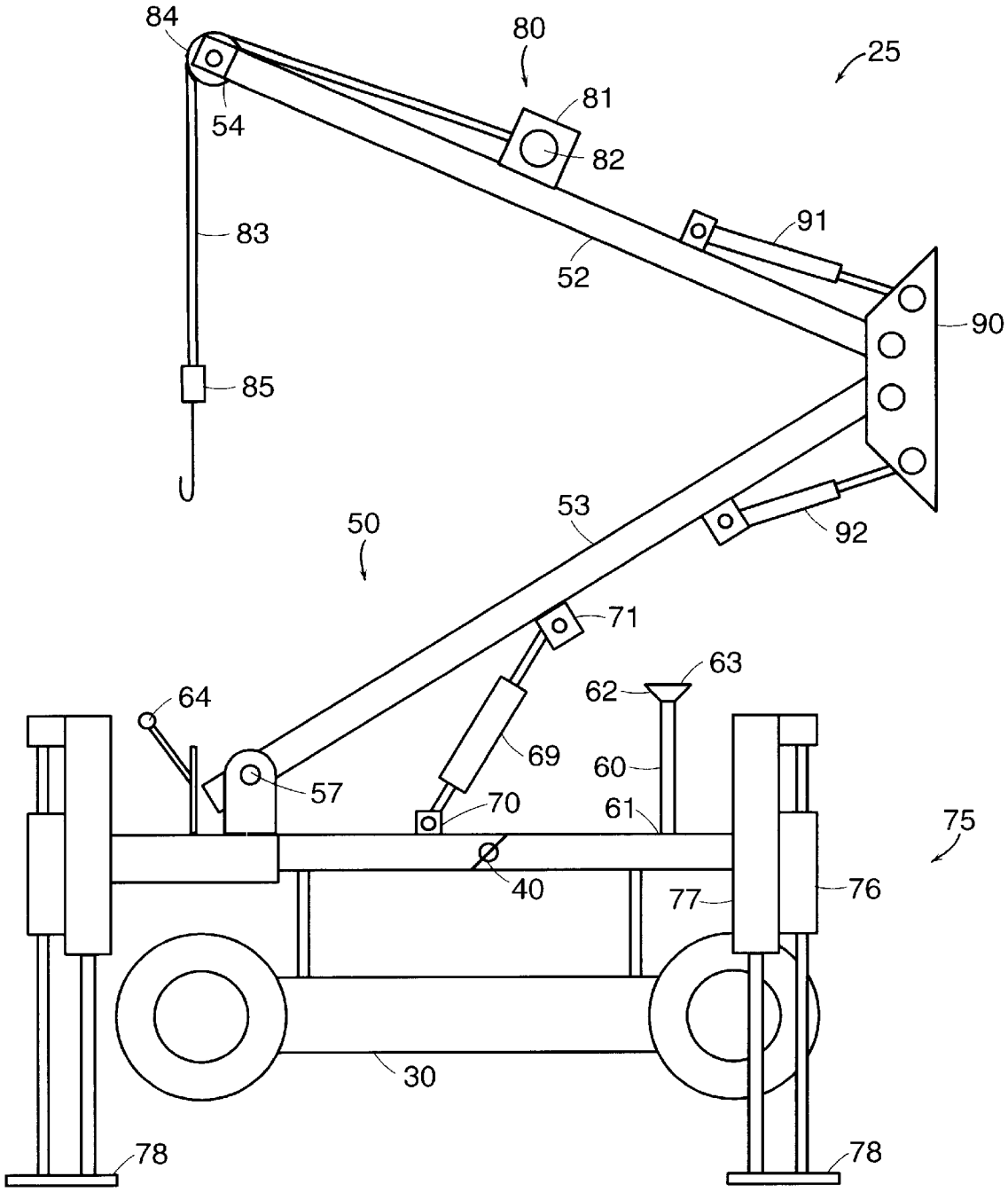
FIG. 2 is a frontal elevational view of the mini hoist with the booms at about half mast.
Figure 3:
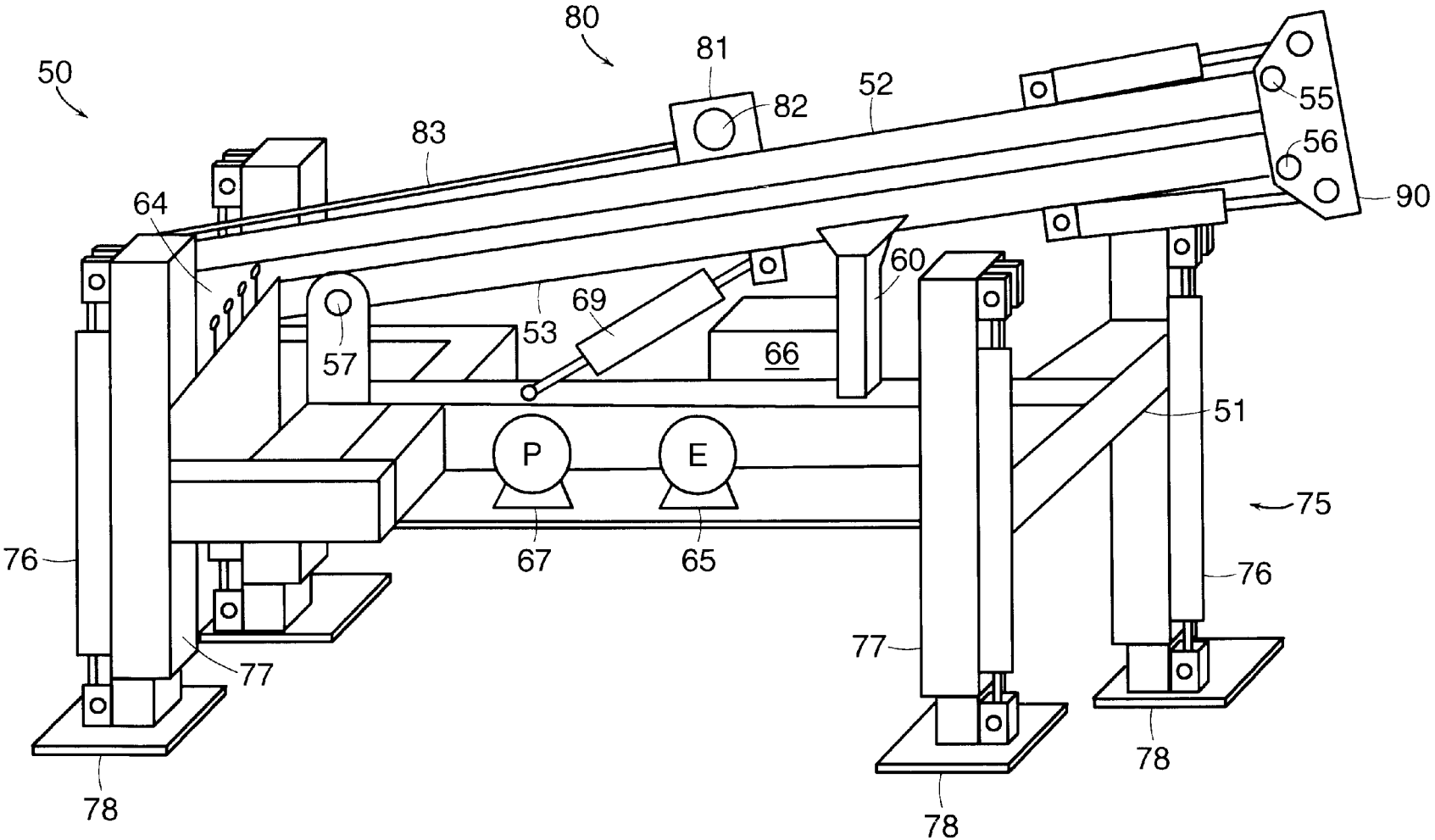
FIG. 3 is a pictorial front view of the hoist assembly with the booms collapsed.
Figure 5:
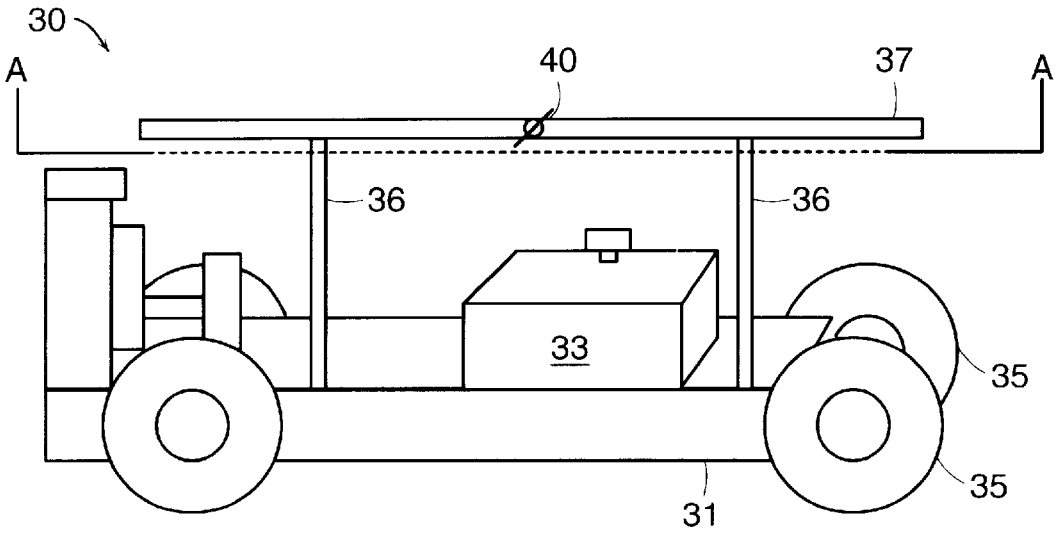
FIG. 5 is a pictorial frontal view of the vehicle.

FIGS. 1–2 depict the mini hoist 25 in various stages of operation. FIG. 1 shows the boom assembly 50 extended to its full height, which is a minimum of 23.5 feet above the ground. This makes it a very important improvement over other small well pipe, post or pole pulling implements. Most of the well pipe pullers that can be used in confined areas, usually will not support the raised pipe for more than a few feet. This inability to support the pipe often causes severe damage to the pipe from bending or buckling. FIG. 3 shows only the boom assembly 50 with the upper and lower boom chassis members 52, 53 collapsed, and removed from the vehicle for illustrative purposes. FIG. 2 shows the mini hoist 25 having the chassis members 52, 53 at about half mast. In this embodiment the boom assembly 50 is removably mounted to a mobile, self-propelled vehicle 30. The vehicle 30 is described in detail in FIGS. 5–6. Two disconnect pins 40 hold the two sections 30 and 50 together. When the pins 40 are removed, the boom assembly 50 can be dismounted within minutes. The vehicle 30 can then be used independently as a utility truck. The vehicle 30 is relatively small; only measuring 38 inches in width; and 11.5 feet in overall length. The vehicle 30 has a box-like carriage 31, with a steel structure that is welded together to form a rigid unit. The carriage 31 is supported by four ground engaging wheels 35, which comprise the four wheel drive.

Figure 6:
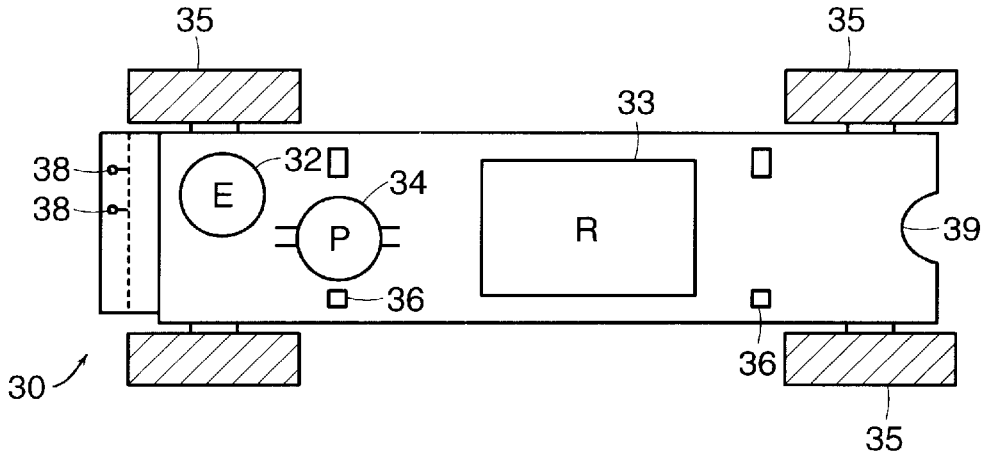
FIG. 6 is a top plan view of the vehicle taken along the line A—A of FIG. 5.

All operating functions of the vehicle, including the four wheel drive are driven by a hydraulic pump 34 which is powered by a gasoline engine 32. Both the pump and the engine being mounted to the carriage 31. Also mounted to the carriage 31 is a hydraulic fluid reservoir tank 33 for storage of the hydraulic fluid. A wet cell storage battery for powering lights is not shown but can be added as an option. The carriage 31 has four vertical posts 36 extending upwardly. Each post 36 having an end welded to the carriage 31, while the other end supports a platform 37. The platform is used for placing objects such as the boom assembly 50. It is on the sides of the platform 37 that the quick disconnect pins 40 are located. FIG. 6 shows a semi-circular cutout aperture 39 located in the front of the carriage 31. This cutout aperture 39 is helpful to the operator to insure that the vehicle 30 is properly aligned in an overlying position to the well bore. All pipe pulling by the mini hoist 25 must be done within front outriggers 75, which will be discussed further. The rear of the vehicle 30, as shown in FIG. 12, has a pair of manually operable control arms 38 which are connected by suitable linkage to control valves (not shown), thereby allowing the operator to control forward, reverse and steering movements. They function very similar to the controls found on front-end loaders marketed under the "Bobcat" trademark. The vehicle 30 is actually turned by playing the arms 38 against each other.

The boom assembly 50 has a rectangularly constructed open frame 51 made from welding steel sections together. The bottom end 57 of the lower boom chassis 53 is pivotally fastened to the support frame 51 while the top end 56 is pivotally connected to the upper boom chassis 52 through a boom connection means 93 in the articulation assembly 90. The articulation assembly 90 having a pair of these boom connection means 93. The upper boom chassis 52 having a lower end 55 which is pivotally connected to a boom connection means 93 in the articulation assembly 90. The upper boom chassis 52 having a distal end 54 which can reach a height of at least 23.5 feet when fully extended. The upper boom chassis 52 and the lower boom chassis 53 have a hollow rectangularly box-like construction for maximum strength and light weight. The articulated assembly 90 allows the booms 52, 53 to be put into a 180 degree relationship with each other when fully extended. The same articulation assembly 90 allows the booms 52, 53 to be in a generally parallel relationship when the apparatus 50 is in the collapsed state. A support beam 60 having a connecting end 61 is fixedly connected to the frame 51 and has an opposing support end 62 extending perpendicularly and upwardly away from the frame 51. This support end 62 has defined in its upper surface a channel 63. When the boom assembly 50 is in the collapsed state, the lower boom chassis 53 is deposed within the channel 63.

A conventional double-acting main lift cylinder 69 is depicted on FIGS. 1–2. The main cylinder 69 having a fastening end 70 pivotally mounted to the frame 51 and an opposite rotating end 71 pivotally connected to the lower boom chassis 53. By activating this cylinder 69, the boom assembly 50 is put into vertical motion.

Figure 4:
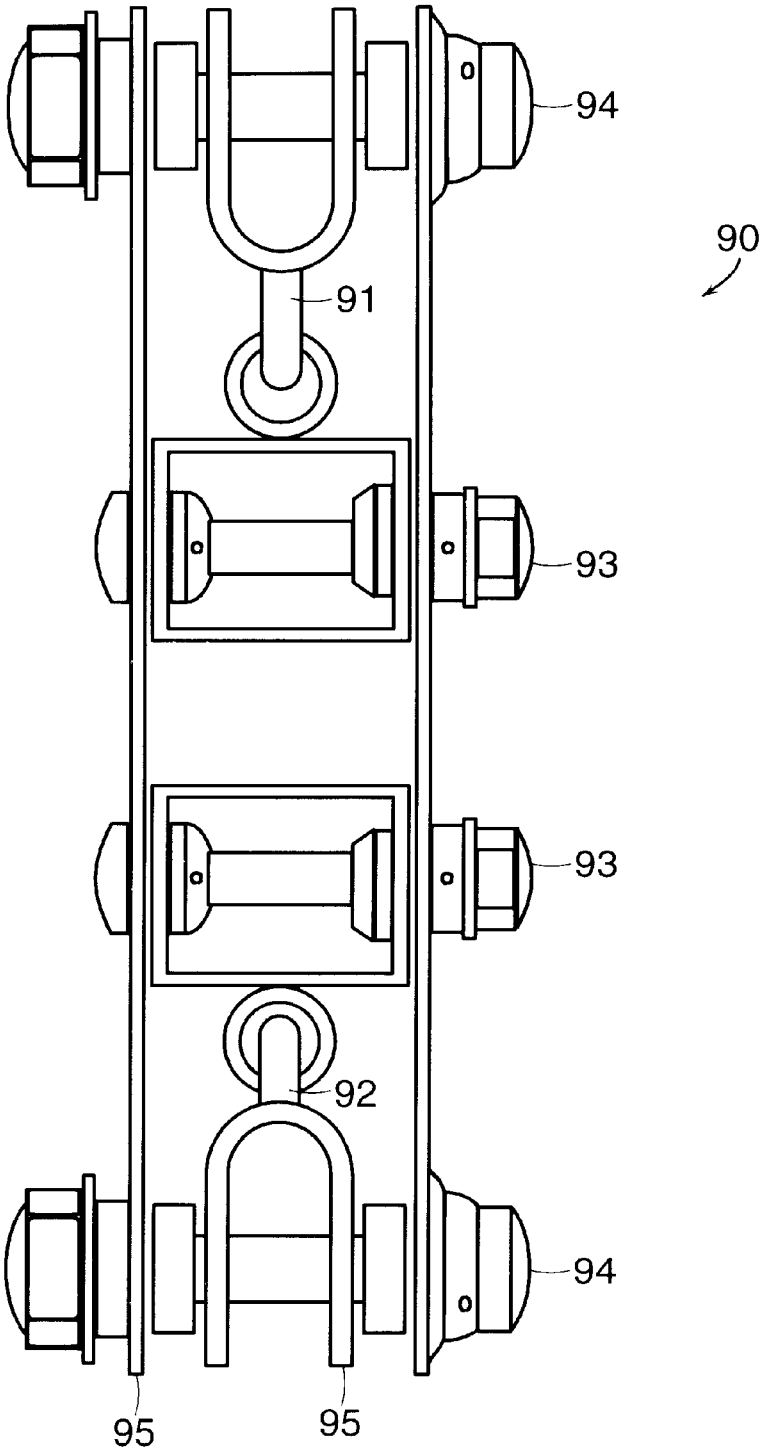
FIG. 4 is a frontal view of the articulation assembly.

The actuated control of the booms 52, 53 by the articulation assembly 90 comprises the major improvement of the present invention. As shown in FIGS. 3–4, the upper articulation cylinder 91 has one end pivotally fastened to the upper portion of the upper boom chassis 52 and a U-bolt connector at the other end is in pivotal contact with the cylinder connection means 94. The lower articulation cylinder 92 has one end pivotally fastened to the lower portion of the lower boom chassis 53 and a U-bolt connector at the other end in pivotal contact with the other cylinder connection means 94. Both the boom and the cylinder connection means 93, 94 include standard pivotal parts such as bolts, nuts, spacers, and washers. They are therefore shown in FIG. 4 but because of their conventionality are not specified in detail. Both the cylinder connecting means 94 and the boom connection means 93 are held in a spaced apart relationship by a pair of semi-octagonal parallel plates 95. These plates 95 form a bracket housing for the articulation assembly 90.

The operator can control the vertical raising of the boom assembly 50 through the control of the double-acting cylinders 69, 91, and 92, by use of a valve bank 64 which is located on the front end of the frame 51. This valve bank 64 is shown in FIGS. 1–3 and comprises at least eight levers which are discussed further in the disclosure.

The frame 51 of the boom assembly 50 has a gasoline engine 65 which powers the entire assembly. This assembly works by hydraulic pressure, whereby hydraulic fluid stored in a reservoir tank 66 is put into motion by a hydraulic pump 67. The tank 66, the pump 67 and the gasoline engine 65 are all standard components mounted on the frame 51.

To start-up the operation of the mini hoist 25, first the vehicle 30 must be maneuvered so that the cutout aperture 39 in the front of the carriage 31 is aligned over the well bore. This is critical to insure stability of the hoist 25. Next, four outriggers 75, which are mounted at approximately each corner of the frame 51, must be energized. These outriggers 75 are depicted by FIGS. 1–3. Each outrigger 75 is comprised of a double acting hydraulic cylinder component 76 having a two foot stroke and integral with the cylinder 76, is a jack 77. Each jack 77 has, at its ground engaging end, a rectangularly shaped foot pad component 78 for increasing the surface area over which the weight of the boom assembly 50 may be spread. The operator, by actuating the jacks 77 will cause the vehicle 30 to be lifted off the ground, thereby placing the boom assembly 50 in ground engaging position. The base area of contact between the assembly 50 and the ground is increased thus allowing for greater stability. It is extremely important that all pulling be done within the two front outriggers 75. Each of the four outriggers 75 can be individually controlled to compensate for terrain irregularities. After the mini hoist 25 is stabilized, the main cylinder 69 and then the articulation cylinders 91, 92 are activated.

The upper boom chassis 52 has a winch assembly 80 mounted on its upper surface depicted by FIGS. 1–3. The assembly 80 has a 20 cubic inch winch motor 81 which hydraulically activates an integral cable spool 82 having steel cable line 83 reeled about it. The cable line 83 is strung from the spool 82 and slidingly revolves through and around a five inch pulley 84 which is rotatively mounted on the distal end 54 of the upper boom chassis 52. The line 83 has a load bearing means 85 by which a pipe, post or pole can be connected. The winch assembly 80 can generate at least 1500 pounds of pulling force. A hydraulic lock valve (not shown) is employed as a safety factor against any unexpected movement.

The boom assembly 50 is controlled by the valve bank 64 which has eight manually manipulative control levers, whereby an operator can manipulate the levers while visually observing the extension and retraction of the booms 52 and 53. Four levers control the outriggers 75; two levers control the two articulation cylinders 91, 92; one lever controls the main cylinder 69; and one lever controls the winch assembly 80. The levers, valves, linkage, fluid hosing and all supplemental connections are all standardized parts. The main cylinder 69, the articulation cylinders 91, 92 and the four outrigger cylinders 76 all have standard safety hydraulic lock valves (not shown).

Thus, it will be seen from the foregoing description that a mini hoist 25 is provided that will pull PVC or steel pipe with a perpendicular lift of at least 23.5 feet. This hoist 25 is small enough to fit into a box or pick-up truck, thereby eliminating the need for a second worker on the job. The overall size of the hoist 25 allows it to reach work sites that would be impossible for a standard type pipe pulling rig.

Another embodiment of the present invention would eliminate the quick disconnect pins 40 and have the mini hoist 25 built with the hoist apparatus 50 and the vehicle 30 as on integral entity. The disadvantage of this embodiment would be in not having the ability to use the vehicle 30 by itself as a utility truck. The advantage, although not really deviating from the overall structural make-up or size, would be in eliminating one gasoline engine, hydraulic reservoir tank and hydraulic pump since only one set of these components would be needed.

It is to be appreciated that the present invention does not limit its inventive concept to some of the stated data of this particular model. The inventor realizes that another embodiment of this invention would be to utilize additional boom structures for increasing the pulling height. Also, three smaller booms could be used instead of the described two booms, to reduce the overall length of the mini hoist.

It is to be understood that the present invention is not limited to the sole embodiment described above, but encompasses any and all embodiments within the scope of the following claims.

I claim:

1. A self propelled mini hoist comprising:

a mobile hydraulically driven self propelled vehicle having a carriage supported by four wheels;

vehicle controlling means mounted to the rear portion of the carriage;

a cutout aperture defined in the front portion of the carriage therein, for use by the operative to align the mini hoist over a well bore;

a boom assembly integrally mounted on the vehicle, the assembly including:

a rectangularly constructed open support frame, a pair of elongate hollow boom chassis, a lower boom chassis and an upper boom chassis, the lower boom chassis having a top end and a bottom end, the bottom end pivotally mounted to the support frame thereof, the upper boom chassis having a distal end and a lower end;

a hydraulic double acting main lift cylinder interconnecting between the frame and the lower porton of the lower boom chassis, for imparting the initial lifting force to the booms;

an articulation assembly having means for pivotally connecting the lower end of the upper boom chassis to the top end of the lower boom chassis, the pivotally connecting means comprising:

hydraulically double acting articulation cylinders, an upper cylinder having one end fixedly attached to the upper surface of the upper boom chassis, a lower cylinder having one end fixedly attached to the lower surface of the lower boom chassis, a pair of spaced apart parallel plates forming a bracket housing, the plates supporting four shaft assemblies for rotation therewith, the plates having suitable clearance holes for rotatably supporting two boom shaft assemblies and two cylinder shaft assemblies, the cylinder shaft assemblies disposed exteriorly of the boom shaft assemblies, each cylinder shaft assembly pivotally connecting the other ends of the upper and lower cylinders, the boom shaft assemblies pivotally connecting the upper boom chassis with the lower boom chassis, whereby upon response to the lifting action of the main cylinder the articulation cylinders are adapted to react such that the distal end of the upper boom will raise perpendicularly upwards;

four parallel outriggers mounted approximately at each corner of the boom assembly for stabilizing the mini hoist during the pulling stage, the two front outriggers positioned forward of the cutout aperture of the vehicle, thereby maintaining the center of gravity within the confines of the hoist;

a hydraulic winch assembly mounted to the upper portion of the upper boom chassis, the winch assembly having means for connecting to well pipe;

a support beam extending vertically upwards from the frame, one end of the beam integral with the frame, the other end of the beam having a channel defined therein, for supporting the lower boom chassis in the collapsed stage; and boom assembly controlling means mounted to the front of the hoist, for allowing the operative to manipulate the boom assembly while visually observing the extension and retraction of the booms, whereby the operative can maneuver the mini hoist to a position overlying the well bore, the well bore thereby within the front outriggers such that the well pipe can be raised vertically.

2. The mini hoist according to claim 1, wherein the carriage of the vehicle includes:

a plurality of vertical posts, each having one end integral with the carriage and extending upwardly thereof; and a rectangularly shaped platform rigidly connected to the other ends of the vertical posts for supporting the frame of the boom assembly.

3. The mini hoist according to claim 2, wherein the platform further has a plurality of quick disconnect pins insertable into the sides, for mounting and dismounting the boom assembly.

4. The mini hoist according to claim 1, wherein the vehicle has a wheel base less than 30 inches and an overall width less than 38 inches.

* * * * *